United States Patent [19]

Wang

[11] Patent Number: 4,956,236

[45] Date of Patent: Sep. 11, 1990

[54] UNORIENTED MONOFILAMENT WITH MULTILOBED CORE

[75] Inventor: Teh-Chaun Wang, Parkersburg, W. Va.

[73] Assignee: E. I. du Pont de Nemours and Company, Wilmington, Del.

[21] Appl. No.: 220,221

[22] Filed: Jul. 18, 1988

Related U.S. Application Data

[63] Continuation-in-part of Ser. No. 92,386, Sep. 2, 1987, abandoned.

[51] Int. Cl.[5] ..... D02G 3/00

[52] U.S. Cl. ..... 428/373; 428/397

[58] Field of Search ..... 428/373, 374, 397; 264/171

[56] References Cited

U.S. PATENT DOCUMENTS

| | | | |
|---|---|---|---|
| 3,551,279 | 12/1970 | Ando et al. . | |
| 3,595,952 | 7/1971 | Boyer et al. | 264/235.6 X |
| 3,700,544 | 10/1972 | Matsui . | |
| 3,725,192 | 4/1973 | Ando et al. . | |
| 3,763,109 | 10/1973 | Witsiepe | 528/301 |
| 4,460,649 | 7/1984 | Park et al. | 428/397 X |
| 4,584,240 | 4/1986 | Herbert et al. | 428/373 |
| 4,707,398 | 11/1987 | Boggs | 428/373 X |

FOREIGN PATENT DOCUMENTS

| | | | |
|---|---|---|---|
| 61-252310 | 10/1986 | Japan | 428/373 |

*Primary Examiner*—Lorraine T. Kendell

*Attorney, Agent, or Firm*—Donald W. Huntley

[57] ABSTRACT

Coextruded, substantially unoriented monofilament having a multi-lobed core and a round sheath.

9 Claims, 1 Drawing Sheet

UNORIENTED MONOFILAMENT WITH MULTILOBED CORE

CROSS-REFERENCE TO RELATED APPLICATION

This is a continuation-in-part of copending application Ser. No. 07/092,386, filed Sept. 2, 1987.

BACKGROUND OF THE INVENTION

Polymeric monofilaments have previously been used in the past for a wide variety of applications. Particularly with large diameter monofilaments, it has been found difficult to attain uniformity in the diameter of the filament.

Sheath-core filaments have previously been proposed, and permit the use of different polymers in sheath and core for a combination of properties that would be unattainable with a single polymer. However, such filaments frequently do not have strong adhesion between the sheath and core, which limits their applicability in high stress environments.

SUMMARY OF THE INVENTION

The present invention provides a sheath-core monofilament which is characterized by outstanding adhesion between sheath and core.

Specifically, the instant invention provides a coextruded, substantially unoriented polymeric monofilament having a diameter of at least about 2.0 mm and having a sheath and a core, the sheath being in intimate contact with the core and having a substantially circular cross-section, and the core having a perimeter greater than that of the sheath, the core comprising a center and from 4 to 14 lobes radiating from the center.

DETAILED DESCRIPTION OF THE INVENTION

The monofilaments of the present invention are coextruded structures having a sheath and a core. These monofilaments are prepared by the general coextrusion techniques described, for example, in U.S. Pat. No. 2,936,482, hereby incorporated by reference. However, the present monofilaments are characterized by a multilobed core.

The core of the present invention has from 4 to 14 lobes. A core having fewer than 4 lobes generally does not give the outstanding interlocking or adhesion between sheath and core. A core with more than 14 lobes results in manufacturing difficulties and gives no significant improvement in the properties of the filament.

Figure 1:
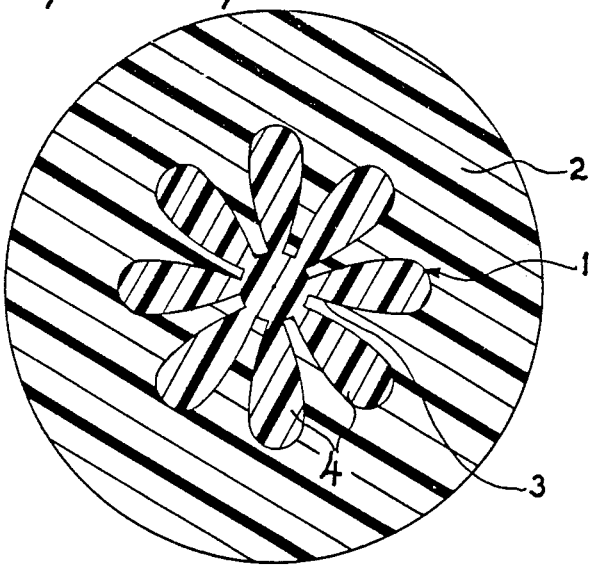
FIG. 1 is a cross-sectional illustration of a monofilament of the present invention.

A representative cross-section of a monofilament of the present invention can be seen in FIG. 1, in which core 1 is surrounded by and in intimate contact with sheath 2. The core is made up of center 3 and lobes 4, which are attached to the center. The perimeter of the core, by virtue of the several lobes, significantly exceeds the perimeter of the outer sheath in length.

This multi-lobed core can be extruded, if desired, through a die having the general configuration of the desired final shape of the core. However, the core is preferably extruded through a die of the type shown in FIG. 2. There, die plate 21 has central orifice 22, through which the center of the core is extruded, and outer orifices 23, through which the lobes of the core are extruded. The sheath is typically extruded around the core in a converging flow, coming in contact with the core components from a direction perpendicular to the flow of the core. In this manner, the flow of the sheath material pushes inward on the outer strands of the core material, elongating them and bringing them into contact with the center of the core. In general, the diameter of the circle on which the die orifices for the outer elements of the core lie is about from 3 to 5 times the diameter of the orifices themselves.

The present coextruded monofilaments are made up of thermoplastic polymers for both the sheath and core components. The particular polymers used can vary widely, depending on the properties and intended uses for the monofilaments. Polyamides, polyesters, polyolefins and thermoplastic elastomers have been found to be particularly satisfactory in the present invention.

The sheath or core of the coextruded monofilaments of the present invention generally comprises at least about 50%, and preferably at least about 70%, of polyesters or polyamides of fiber-forming molecular weight.

Polyamides which can be used in the present invention include polycaprolactam (nylon 6), nylon 612 nylon 610 and nylon 66, or blends of nylon 6 with other polymers in which the nylon 6 represents at least about 60 percent of the blend. Representative polymers with which the nylon 6 can be blended include nylon 11, nylon 12 and nylon 6,6.

Polyesters which can be used include such as polyethylene terephthalate, polybutylene terephthalate and blends of each of these with each other and other polymers such as elastomers. Elastomers which can be so used include, for example, copolyetheresters such as that commercially available from E. I. du Pont de Nemours and Company as Hytrel® copolyetherester.

A particularly desirable polymer blend for use as the core material in the present coextruded monofilaments is at least about 80 percent polybutylene terephthalate and at least about 5 percent of a copolymer of tere- and iso-phthalic acids, 1,4-butane diol and polytetramethylene ether glycol. Such copolyetherester polymers can be prepared according to the teachings of Witsiepe, U.S. Pat. Nos. 3,651,014 and 3,763,109, both of which are hereby incorporated by reference.

The particular combination of polymers used in the sheath and core will depend on the properties desired in the finished products. However, in general, to provide good long term wear characteristics, it is preferred to use a polyester core and a polyamide sheath. This combination of materials also gives tensile properties that are particularly satisfactory for push-pull applications.

The coextruded monofilaments of the present invention are substantially unoriented. Accordingly, after extrusion, the filaments are not drawn, as by typical procedures, but quenched immediately after extrusion or shortly thereafter. The monofilaments typically have a diameter of about from 1 to 4 mm, depending on the strength required in the final product. After extrusion, the coextruded monofilament can be further treated to improve other physical properties, as by steam conditioning described in Boyer et al. U.S. Pat. No. 3,595,952.

The resulting products are substantially confirmed by x-ray diffraction techniques, as will be evident to those skilled in the art.

The monofilaments of the present invention have been found to be surprisingly useful in applications in which the filaments are subjected to push-pull forces, such as power antennas in automobiles. Despite the lack of orientation, which has previously been thought necessary for strength in a polymeric monofilament, the present filaments have been found to exhibit excellent performance over push-pull cycles of 60,000 or more, even at markedly elevated temperatures of about 80° C.

The present invention is further illustrated by the following specific example, in which parts and percentages are by weight unless otherwise indicated.

EXAMPLE

Figure 2:
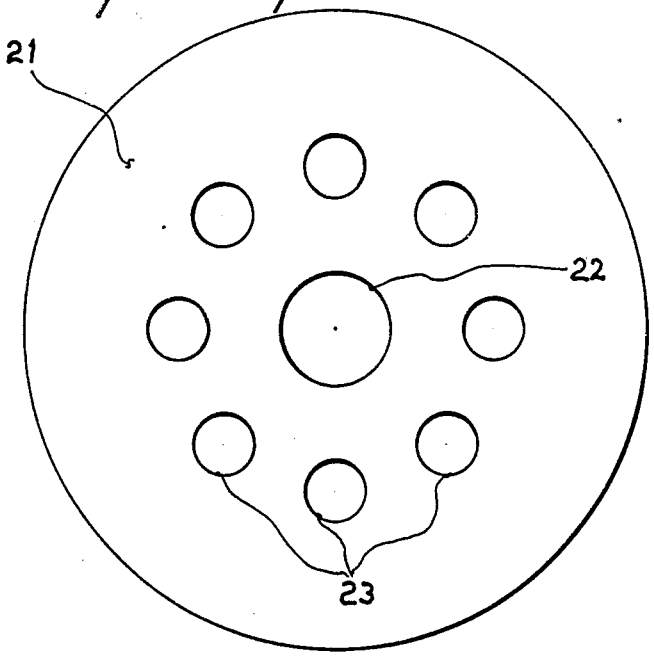
FIG. 2 is a plan view of an extrusion die which can be used to prepare a monofilament of the present invention.

Coextruded monofilaments were prepared using a die similar to that shown in FIG. 2. The die plate had a center orifice having a diameter of 0.07 inch and eight satellite orifices having the same diameter positioned in a circle around the center orifice. The outer circle had a diameter of 0.305 inch. Core material of polybutylene terephthalate was extruded through this die in a substantially vertical direction. Molten nylon 66 was extruded as the sheath polymer in a direction substantially perpendicular to the nine strands of core polymer. The ratio of sheath material to core material was 80/20.

Upon convergence of the sheath and core materials, the sheath material aided in the elongation of the configuration of the satellite strands of core material and in joining them with the central core filament to form the daisy configuration as shown in FIG. 1. The resulting monofilaments were quenched in a water bath immediately after extrusion, without drawing to orient the polymeric components.

The resulting monofilaments had a diameter of mm. The filaments were tested according to standard procedures as described in Boyer et al., U.S. Pat. No. 3,595,952, previously incorporated by reference, and found to exhibit the following tensile properties:

| | | |
|---|---|---|
| TENSILE STRENGTH | 9600 PSI | |
| TENSILE MODULUS | −30° C. | 485,000 |
| | +23° C. | 358,000 |
| | +80° C. | 85,000 |

The monofilaments are suitable for transmitting power in a push-pull mode with a light load such as an automobile power antenna. In such applications, the filaments will function satisfactorily through 60,000 cycles at temperatures of up to about 80° C.

I claim:

1. A coextruded, substantially unoriented, polymeric monofilament having a diameter of at least about 2.0 mm and having a sheath and a core, the sheath being in intimate contact with the core and having a substantially circular cross-section, and the core having a perimeter greater than that of the sheath, the core comprising a center and about from 4 to 14 lobes radiating from the center, the monofilament having a tensile strength of at least about 9,600 psi and a tensile modulus of at least about 85,000 at 80° C.

2. A coextruded monofilament of claim 1 wherein the core is a polyester.

3. A coextruded monofilament of claim 2 wherein the core is at least about 50 percent polybutylene terephthalate.

4. A coextruded monofilament of claim 2 wherein the sheath comprises at least about 50% polyamide.

5. A coextruded monofilament of claim 4 wherein the sheath consists essentially of nylon 66.

6. A coextruded monofilament of claim 4 wherein the sheath consists essentially of poly(hexamethylene dodecanoamide) (nylon 612).

7. A coextruded monofilament of claim 1 wherein the core comprises from 5 to 9 lobes.

8. A coextruded monofilament of claim 7 wherein the core comprises 8 lobes.

9. A coextruded monofilament of claim 7 wherein the core comprises 6 lobes.

* * * * *